US007754257B2

(12) United States Patent
Matsumoto et al.

(10) Patent No.: US 7,754,257 B2
(45) Date of Patent: Jul. 13, 2010

(54) PACKING CONTAINER

(75) Inventors: Makoto Matsumoto, Tokyo-To (JP); Makoto Takahashi, Tokyo-To (JP); Susumu Niwa, Tokyo-To (JP); Tadayuki Koyanagi, Tokyo-To (JP)

(73) Assignee: Kabushiki Kaisha Hosokawa Yoko, Tokyo-To (JP)

( * ) Notice: Subject to any disclaimer, the term of this patent is extended or adjusted under 35 U.S.C. 154(b) by 1043 days.

(21) Appl. No.: 10/967,218

(22) Filed: Oct. 19, 2004

(65) Prior Publication Data

US 2005/0084568 A1 Apr. 21, 2005

(30) Foreign Application Priority Data

Oct. 20, 2003 (JP) ..... 2003-359304

(51) Int. Cl.
*B65D 81/38* (2006.01)

(52) U.S. Cl. ..... 426/115; 426/127; 426/130; 220/592.2

(58) Field of Classification Search ..... 426/115, 426/106, 112, 127, 130; 383/110, 104; 220/592.2, 220/903
See application file for complete search history.

(56) References Cited

U.S. PATENT DOCUMENTS 3,098,560 A * 7/1963 Skees ..... 426/106
3,603,106 A * 9/1971 Ryan et al. ..... 62/457.4
3,734,395 A * 5/1973 Erk et al. ..... 383/121
4,136,205 A * 1/1979 Quattlebaum ..... 426/412
4,172,152 A * 10/1979 Carlisle ..... 426/127
4,521,910 A * 6/1985 Keppel et al. ..... 383/10
4,797,010 A * 1/1989 Coelho ..... 383/109
4,802,233 A * 1/1989 Skamser ..... 383/15
4,940,736 A * 7/1990 Alteepping et al. ..... 521/98
4,961,944 A * 10/1990 Matoba et al. ..... 426/107
5,628,453 A * 5/1997 MacLaughlin ..... 229/403
5,765,710 A 6/1998 Bergerioux (Continued)

FOREIGN PATENT DOCUMENTS

CN 1129435 A 8/1996

(Continued)

OTHER PUBLICATIONS

The world of poylethylene website, 2007, http://plastics.dabic.eu/technical/_en/theworldof po.htm.*

(Continued)

*Primary Examiner*—Drew E Becker
(74) *Attorney, Agent, or Firm*—Birch, Stewart, Kolasch & Birch, LLP

(57) ABSTRACT

A packing package includes a gusseted container formed from laminated films and having opposite side walls and gussets extending between the opposite side walls, and a spout attached to an opening in the gusseted container. The laminated film forming either the two opposite side walls or the gussets is provided with a heat insulating barrier. The laminated film forming the gussets is not provided with any heat insulating barrier when the two opposite side walls are formed from the laminated film provided with a heat insulating barrier. The laminated film forming the two opposite side walls is not provided with any heat insulating barrier when the gussets are formed from the laminated film provided with a heat insulating barrier.

6 Claims, 2 Drawing Sheets

U.S. PATENT DOCUMENTS

| | | | | |
|---|---|---|---|---|
| 6,138,902 | A * | 10/2000 | Welch | 229/103.11 |
| 6,652,933 | B2 * | 11/2003 | Hall | 428/34.2 |
| 6,814,253 | B2 * | 11/2004 | Wong | 220/739 |
| 6,913,389 | B2 * | 7/2005 | Kannankeril et al. | 383/91 |
| 7,005,150 | B2 * | 2/2006 | Kuge et al. | 426/85 |
| 7,111,753 | B2 * | 9/2006 | Scheetz et al. | 215/12.1 |
| 2002/0071922 | A1 | 6/2002 | Bailey | |
| 2003/0106895 | A1 * | 6/2003 | Kalal | 220/9.2 |
| 2005/0013905 | A1 * | 1/2005 | Hughes | 426/106 |
| 2005/0079251 | A1 * | 4/2005 | Bell | 426/115 |

FOREIGN PATENT DOCUMENTS

| | | | |
|---|---|---|---|
| EP | 1 010 639 | A1 | 6/2000 |
| EP | 1 048 588 | A1 | 11/2000 |
| JP | 2000-103438-(A) | | 4/2000 |
| WO | WO0194235 | A1 * | 12/2001 |

OTHER PUBLICATIONS

Translation for JP12103438.*

* cited by examiner

PACKING CONTAINER

This Nonprovisional application claims priority under 35 U.S.C. §119(a) on Patent Application No(s). 2003-359304 filed in Japan on Oct. 20, 2003, the entire contents of which are hereby incorporated by reference.

BACKGROUND OF THE INVENTION

1. Field of the Invention

The present invention relates to a packing container for containing a cold sweet, such as ice cream or sherbet, or hot beverage, such as tea or soup.

2. Description of the Related Art

A gusseted packing container disclosed in JP-A No. 2000-103438 (p. 2, FIG. 1) is a packing container for containing a beverage, such as juice, or a jelly food. This gusseted packing container has a gusseted container formed from a laminated film, and a spout fixedly fitted in an opening formed in the gusseted container. The laminated film is formed by laminating a polyester film, an aluminum foil, an oriented nylon film and a low-density polyethylene film. The laminated film does not have any heat insulating barrier. Generally, the gusseted packing container containing a beverage or a jelly food is stored in a cold chamber of a refrigerator to hold the beverage of the jelly food at a low temperature. When drinking the beverage contained in the gusseted packing container, the gusseted packing container containing the beverage is taken out of the cold chamber of the refrigerator, a cap attached to the spout is removed, the spout is applied to the mouth, and the opposite side walls of the gusseted packing container are pressed with fingers.

Since the gusseted packing container containing the beverage or the jelly food is kept in the cold chamber, the surfaces of the opposite side walls of the gusseted packing container immediately after the gusseted packing container has been taken out of the cold chamber are at a low temperature above the freezing point. Therefore, the fingers pressing the opposite side walls of the gusseted packing container merely feel cold and will not be chilled. When the gusseted packing container contains ice cream, the gusseted packing container is stored in a freezer compartment to keep the ice cream at a temperature below the freezing point. Therefore, the surfaces of the opposite side walls of the gusseted packing container containing the ice cream immediately after the gusseted packing container has been taken out of the freezer compartment of the refrigerator are at a temperature below the freezing point. When the opposite side walls of the gusseted packing container at such a low temperature are pressed with fingers, the fingers will be chilled, the fingers are unable to press the side walls continuously and, consequently, the person is unable to eat the ice cream easily. Moreover, dew forms on the surfaces of the opposite side walls due to temperature difference between the opposite side walls of the gusseted packing container and the atmosphere and the surfaces of the opposite side walls are wetted with water.

When the gusseted packing container contains a soup, the gusseted packing container is stored in a heating compartment of a heating device to keep the soup hot. When the gusseted packing container containing the soup is taken out of the heating compartment, the surface temperature of the opposite side walls of the gusseted packing container is considerably high. Consequently, the fingers are unable to press the opposite side walls continuously and the person is unable to drink the soup easily.

SUMMARY OF THE INVENTION

The present invention has been made in view of the foregoing problems and it is therefore an object of the present invention to provide a packing container that enables a person to take out the contents of the packing package regardless of the temperature of the contents by pressing the opposite side walls of the packing container with the fingers continuously.

A packing package according to the present invention includes: a gusseted container formed from laminated films and having opposite side walls and gussets extending between the opposite side walls; and a spout attached to an opening in the gusseted container; wherein the laminated film forming either the two opposite side walls or the gussets is provided with a heat insulating barrier, the laminated film forming the gussets not being provided with any heat insulating barrier when the two opposite side walls are formed from the laminated film provided with a heat insulating barrier, and the laminated film forming the two opposite side walls not being provided with any heat insulating barrier when the gussets are formed from the laminated film provided with a heat insulating barrier.

When a cold sweet, such as ice cream or sherbet, contained in the packing container needs to be frozen quickly, heat can be removed from the cold sweet through the gussets formed from the laminated film not provided with any heat insulating barrier to cool the cold sweet. When a person drinks the cold sweet contained in the packing container, the person presses the opposite side walls formed from the laminated film provided with the heat insulating barrier. Therefore, the fingers are not chilled excessively and the fingers are able to press the opposite side walls continuously.

When a beverage, such as tea or soup, contained in the packing container needs to be heated, heat can be transferred to the beverage through the gussets formed from the laminated film not provided with any heat insulating barrier to heat the beverage. When a person drinks the hot beverage contained in the packing container, the person presses the opposite side walls formed from the laminated film provided with the heat insulating barrier. Therefore, the fingers are not heated excessively and the fingers are able to press the opposite side walls continuously.

BRIEF DESCRIPTION OF THE DRAWINGS

The above and other objects, features and advantages of the present invention will become more apparent from the following description taken in connection with the accompanying drawings, in which.

DESCRIPTION OF THE PREFERRED EMBODIMENTS

Figure 1:
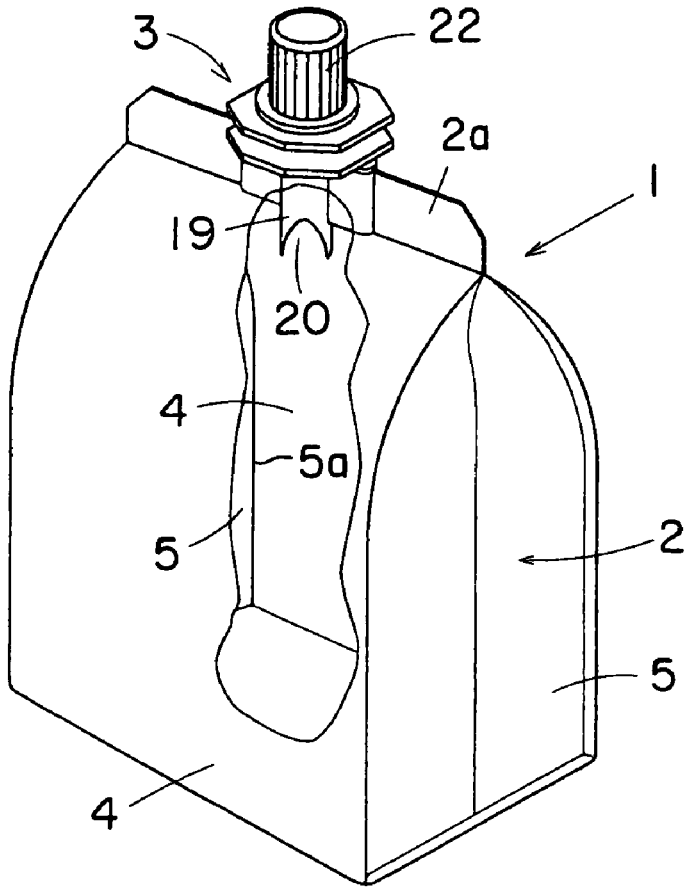
FIG. 1 is a partially cutaway perspective view of a packing container in a preferred embodiment according to the present invention.

Referring to FIG. 1, a packing container 1 in a preferred embodiment according to the present invention has a gusseted container 2 having an upper open end 2*a* and a spout 3 attached to the upper open end 2*a* of the gusseted container 2. The gusseted container 2 has opposite side walls 4, and gussets 5 respectively extending between the side edges of the opposite side walls 4. The gussets 5 have folds 5*a* and can be folded along the folds 5*a*, respectively, so as to protrude toward each other. The opposite side walls 4 are formed from a laminated plastic film 6 provided with a heat insulating barrier. The gussets 5 are formed from a laminated plastic film 7 not provided with any heat insulating barrier. Although the gussets 5 are formed from the laminated plastic film 7 not provided with any heat insulating barrier, the gussets 5 are not necessarily not heat insulating at all, and are less heat insulating than the side walls 4.

Figure 2:
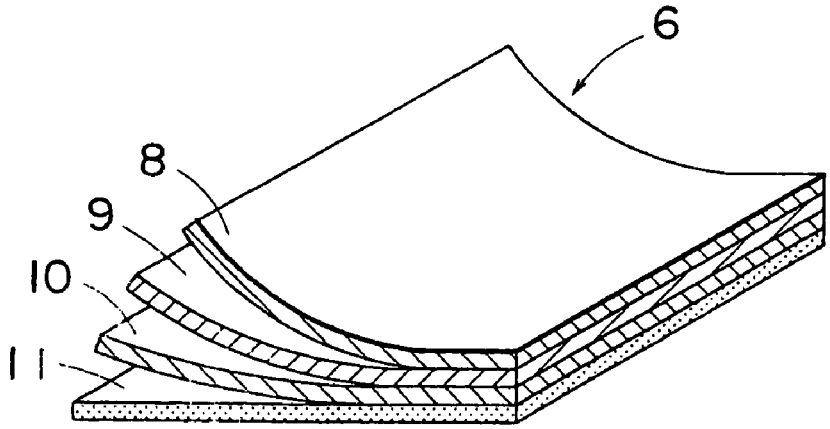
FIG. 2 is a typical perspective view of a laminated film for forming the opposite side walls of the packing container shown in FIG. 1.

As shown in FIG. 2, the laminated plastic film 6 is formed by laminating a 12 μm thick polyester film 8, a polypropylene nonwoven fabric 9 of 50 g/m$^2$ in basis weight serving as a heat insulating barrier, a 15 μm thick oriented nylon film 10 and a 70 μm thick low-density polyethylene film 11 in that order. The polypropylene nonwoven fabric 9 and the oriented nylon film 10 may be interchanged. When a pouch having a heat-sealed edge part is formed by folding the laminated plastic film 6 and heat-sealing a peripheral part of the pouch, the heat insulating effect of the polypropylene nonwoven fabric 9 can be enhanced by melting an edge part of the polypropylene nonwoven fabric 9 to seal air layers in the polypropylene nonwoven fabric 9. The polypropylene nonwoven fabric 9 of the laminated plastic film 6 may be substituted by a polyethylene nonwoven fabric, a foamed polyethylene sheet or a foamed polypropylene sheet. Any one of various sheets capable of forming an air layer of a thickness when a peripheral part thereof is sealed may be used as the heat insulating layer.

Another example of the laminated plastic film 6 is formed by laminating a 12 μm thick polyester film, a 15 μm thick oriented nylon film, a 15 μm thick low-density polyethylene film, a low-density polyethylene nonwoven fabric of 50 g/m$^2$ in basis weight serving as a heat insulating layer, and a 70 μm thick linear low-density polyethylene film in that order.

Figure 3:
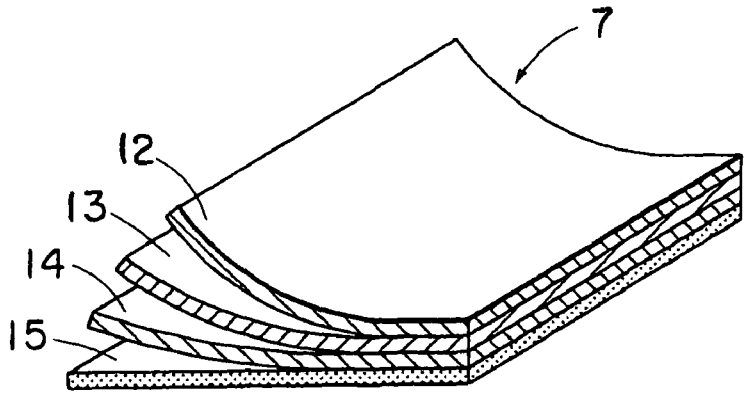
FIG. 3 is a typical perspective view of a laminated film for forming the gussets of the packing container shown in FIG. 1.
Figure 4:
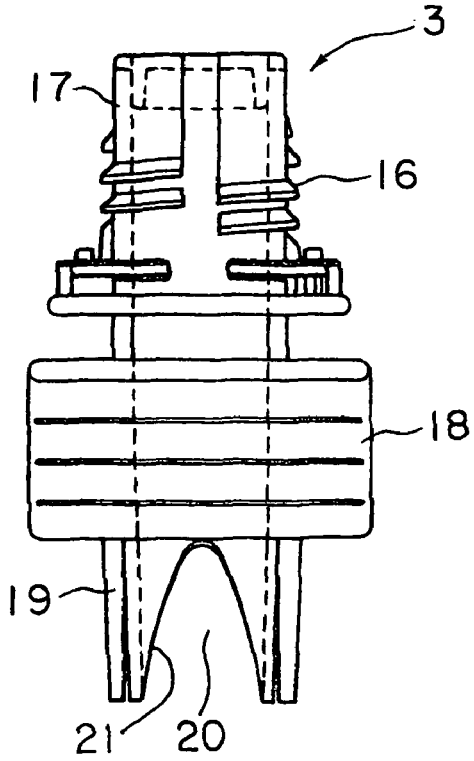
FIG. 4 is a side elevation of a spout included in the packing container shown in FIG. 1.

As shown in FIG. 3, the laminated plastic film 7 is formed by laminating a 12 μm thick polyester film 12, a 7 μm thick aluminum foil 13, a 15 μm thick oriented nylon film 14 and a 70-μm thick straight-chain low-density polyethylene film 15 in that order. The laminated plastic film 7 does not have any heat insulating barrier and a heat insulating property.

The spout 3 has a mouth part 17 having a threaded part 16, a joining part 18 formed integrally with the mouth part 17, and a conduit 19 extending downward from the joining part 18. The conduit 19 has a flat constricted part 20 having opposite flat walls defining an opening 21. A cap 22 is screwed on the threaded part 16 of the mouth part 17.

Suppose that ice cream is packed in the packing container 1. Then, a filling nozzle, not shown, is put to the mouth part 17 of the spout 3 and the ice cream is supplied into the packing container 1 through the filling nozzle. The packing container 1 filled with the ice cream is placed in a freezer compartment of a refrigerator to keep the ice cream at a temperature below the freezing point. The packing container 1 has the opposite side walls 4 formed from the laminated plastic film 6 provided with the heat insulating barrier and the gussets 5 formed from the laminated plastic film 7 not provided with any heat insulating barrier. Therefore, cold is transmitted through the substantially not heat insulating gussets 5 to the ice cream contained in the packing container 1 to keep the ice cream chilled by quick freezing at a temperature below the freezing point.

To eat the ice cream contained in the packing container 1, the packing container 1 filled up with the ice cream is taken out of the freezing compartment of the refrigerator and the packing container 1 is kept in a place at a normal temperature. Then, heat is transferred from the atmosphere through the gussets 5 to the ice cream contained in the packing container 1 to soften the ice cream contained in the packing container 1. After the ice cream contained in the packing container 1 has started melting, the cap 22 is removed from the mouth part 17, a person's mouth is applied to the spout 3 to suck the ice cream, and the opposite side walls 4 of the packing container 1 are pressed with fingers to squeeze out the ice cream through the spout 3. Since the side walls 4 are formed from the laminated plastic film 6 provided with the heat insulating barrier, the fingers pressing the side walls 4 will not be excessively chilled.

In the packing container 1 in this embodiment, the side walls 4 are formed from the laminated plastic film provided with the heat insulating barrier so that the fingers pressing the side walls may not be excessively chilled. In a packing container having opposite side walls and opposite gussets of a size approximately equal to that of the side walls, and a substantially square cross section, the gussets may be formed from a laminated plastic film provided with a heat insulating barrier so that the fingers pressing the gussets may not be excessively chilled.

Suppose that soup is packed in the packing container 1. Then, a filling nozzle, not shown, is put to the mouth part 17 of the spout 3 and the soup is supplied into the packing container 1 through the filling nozzle. The packing container 1 filled with the soup is placed in a warming compartment of a warmer to keep the soup at a temperature suitable for drinking. Heat of hot air in the warming compartment is transferred through the gussets 5 substantially not heat insulating to the soup contained in the packing container 1 to keep the soup at a predetermined temperature.

To drink the soup contained in the packing container 1, the packing container 1 filled up with the soup is taken out of the warming compartment of the warmer, the cap 22 is removed from the mouth part 17, a person's mouth is applied to the spout 3 to suck the soup, and the opposite side walls 4 of the packing container 1 are pressed with fingers to squeeze out the soup through the spout 3. Since the side walls 4 are formed from the laminated plastic film 6 provided with the heat insulating barrier, the surfaces of the side walls 4 are not excessively hot to the fingers pressing the side walls 4.

The gusseted container 2 may be a self-supporting container having opposite side walls 4, gussets 5 respectively extending between the side edges of the opposite side walls 4, having folds 5*a* and can be folded along the folds 5*a*, respectively, so as to protrude toward each other, and a bottom wall, not shown.

Heat insulating properties of sample pouches 1 to 6 were examined. Sample pouches 1 to 3 are examples of the packing container of the present invention and sample pouches 4 to 6 are comparative examples.

Construction of Films Forming Sample Pouches

Film 1 for Forming Sample Pouch 1: Polyester film of 12 μm in thickness/polyethylene nonwoven fabric of 30 g/m$^2$ in basis weight/oriented nylon film of 5 μm in thickness/straight-chain low-density polyethylene film of 70 μm in thickness Film 2 for forming Sample Pouch 2: Polyester film of 12 μm in thickness/polypropylene nonwoven fabric of 40 g/m$^2$ in basis weight/oriented nylon film of 15 μm in thickness/straight-chain low-density polyethylene film of 70 μm in thickness Film 3 for Forming Sample Pouch 3: Polyester film of 12 μm in thickness/polypropylene nonwoven fabric of 50 g/m$^2$ in basis weight/oriented nylon film of 15 μm in thickness/straight-chain low-density polyethylene film of 70 μm in thickness Film 4 for Forming Sample Pouch 4: Oriented polypropylene film of 20 μm in thickness/paper sheet of 53 g/m$^2$ in basis weight/polyethylene film of 30 μm in thickness Film 5 for Forming Sample Pouch 5: Polyester film of 12 μm in thickness/metallized oriented nylon film of 15 μm in thickness/low-density polyethylene film of 100 μm in thickness Film 6 for forming Sample Pouch 6: Polyester film of 12 μm in thickness/aluminum foil of 7 μm in thickness/oriented nylon film of 15 μm in thickness/low-density polyethylene film of 70 μm in thickness Measurement Sample pouches 1 to 6 of 10 sq. cm were formed, the sample pouches 1 to 6 were filled up with water and sealed. The sample pouches 1 to 6 containing water were kept for 24 hr in a refrigerator cooled at −15° c. The sample pouches 1 to 6 were taken out of the refrigerator and the surface temperatures of the sample pouches 1 to 6 were measured at intervals for 5 min in an atmosphere of 25° C.

Measured Results

| Sample No. Time (s) | 1 | 2 | 3 | 4 | 5 | 6 |
|---|---|---|---|---|---|---|
| | Surface temperature (° C.) | | | | | |
| 0 | 4 | 3 | 5 | −5 | −8 | −8 |
| 30 | 6 | 5 | 6 | −5 | −9 | −9 |
| 60 | 6 | 5 | 5 | −1 | −9 | −9 |
| 120 | 8 | 5 | 6 | −1 | −7 | −8 |
| 180 | 8 | 5 | 6 | 0 | −4 | −6 |
| 240 | 8 | 6 | 7 | 2 | −3 | −5 |
| 300 | 10 | 6 | 8 | 2 | −1 | −3 |
| Degree of dew formation | little | little | little | much | ice formed | ice formed |

As obvious from Table 1, the surface temperatures of the sample pouches 1, 2 and 3 were not lower than 0° C. immediately after the sample pouches 1, 2 and 3 were taken out of the refrigerator and dew formed scarcely on the sample pouches 1, 2 and 3. The surface temperatures of the sample pouches 4, 5 and 6 were not higher than 0° C. immediately after the sample pouches 4, 5 and 6 were taken out of the refrigerator and much dew or ice formed on the sample pouches 4, 5 and 6.

Although the invention has been described in its preferred embodiments with a certain degree of particularity, obviously many changes and variations are possible therein. It is therefore to be understood that the present invention may be practiced otherwise than as specifically described herein without departing from the scope and spirit thereof.

What is claimed is:

1. A packing container comprising:

a gusseted container formed from laminated films and having opposite side walls and gussets extending between the opposite side walls; and a spout attached to an opening in the gusseted container, wherein the laminated films include a first laminated film provided with a heat insulating barrier and a second laminated film having a heat insulating degree lower than that of the first laminated film, either the two opposite side walls or the gussets are formed from the first laminated film or the second laminated film, the gussets are formed from the second laminated film when the two opposite side walls are formed from the first laminated film, and the two opposite side walls are formed from the second laminated film when the gussets are formed from the first laminated film, and wherein the first laminated film includes a first plastic film, a nonwoven fabric as the heat insulating barrier and a second plastic film, and a peripheral part of the nonwoven fabric sandwiched between the first and the second plastic film is sealed together with the first and second plastic film by a heat-sealing means to seal air in the nonwoven fabric.

2. The packing container according to claim 1, wherein the two opposite side walls are formed from the first laminated film.

3. The packing container according to claim 1, wherein the gusseted container further has a bottom wall and is a self-supporting container.

4. The packing container according to claim 1, wherein the peripheral part of the nonwoven fabric is sealed when a pouch having a heat-sealed edge part is formed in a heat-sealing process.

5. The packing container according to claim 1, wherein the gusseted container contains a chilled sweet.

6. The packing container according to claim 1, wherein the gusseted container contains a heated beverage.

* * * * *